US005088942A

United States Patent [19]

Welsh et al.

[11] Patent Number: 5,088,942

[45] Date of Patent: Feb. 18, 1992

[54] CLOSED ENTRY SOCKET CONTACT ASSEMBLY

[75] Inventors: David E. Welsh, Tustin; David Rofer, Fountain Valley, both of Calif.

[73] Assignee: ITT Corporation, New York, N.Y.

[21] Appl. No.: 729,916

[22] Filed: Jul. 15, 1991

Related U.S. Application Data

[63] Continuation of Ser. No. 578,981, Sep. 7, 1990, abandoned.

[51] Int. Cl.[5] ..... H01R 13/187

[52] U.S. Cl. ..... 439/843; 439/856

[58] Field of Search ..... 439/842, 843, 851, 852, 439/856, 857, 862, 844

[56] References Cited

U.S. PATENT DOCUMENTS

| | | | |
|---|---|---|---|
| 3,083,351 | 3/1963 | Nielsen, Jr. . | |
| 3,120,418 | 2/1964 | Deakin | 439/560 |
| 3,155,450 | 11/1964 | Filson | 439/851 X |
| 3,697,934 | 10/1972 | Merry . | |
| 3,853,389 | 12/1974 | Occhipinti . | |
| 4,076,369 | 2/1978 | Ostapovitch . | |
| 4,120,556 | 10/1978 | Waldron et al. . | |
| 4,566,752 | 1/1986 | Hemmer . | |
| 4,606,599 | 8/1986 | Grant et al. | 439/857 |
| 4,666,227 | 5/1987 | Galizia et al. . | |
| 4,734,064 | 3/1988 | Knapp et al. | 439/852 |
| 4,780,097 | 10/1988 | Piscitelli | 439/843 |
| 4,834,681 | 5/1989 | Chaillot | 439/856 |
| 4,845,587 | 6/1989 | Lancella | 439/851 |

FOREIGN PATENT DOCUMENTS

| | | |
|---|---|---|
| 2751962 | 5/1979 | Fed. Rep. of Germany . |
| 54552 | 5/1950 | France . |
| 682597 | 11/1952 | United Kingdom . |

*Primary Examiner*—Neil Abrams
*Assistant Examiner*—Khiem Nguyen
*Attorney, Agent, or Firm*—Thomas L. Peterson

[57] ABSTRACT

A high reliability socket contact assembly is provided, of the type that has a seamless exterior, which has tines with closely spaced initial and final points of pin contact engagement, and which has a closed entry region limiting the size of pin contacts that can be inserted, which can be constructed at low cost. The assembly includes a seamless barrel (12, FIG. 3) having a cylindrical cavity (16) extending into its front end, and a clip (20) formed of sheet metal rolled into a tube and lying in the cavity. The clip has a rearward portion (32), tines (**42*a*–42*d*) extending forwardly from the rearward portion and having free forward tips, and a forward portion. The tips (56) of the tines have radially inner edges (60) lying on a first imaginary circle, and the forward portion of the barrel forms a closed entry region (72) having an inside diameter no greater than the diameter of the first imaginary circle, to prevent entry of pins of a diameter that could damage the tines. In one barrel (FIG. 3), the forward barrel portion has a flared front part (80), with the narrowest part of the flare forming the closed end region. In another clip, (FIG. 9) the sheet metal forming the clip is thinner at the tines than at the forward portion (146**) lying forward of the tines.

11 Claims, 5 Drawing Sheets

FIG. 4
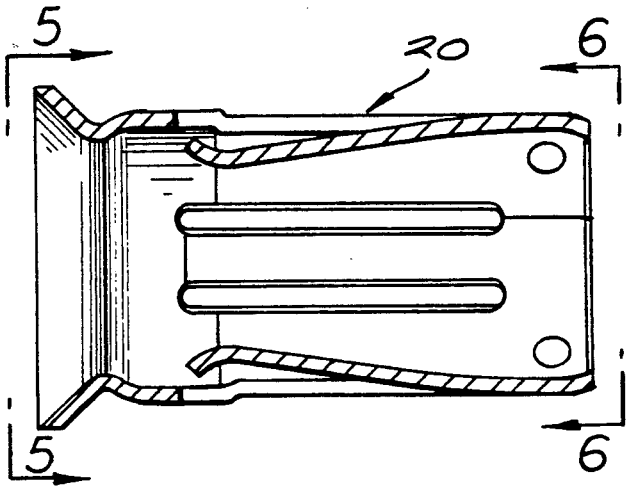
FIG. 5
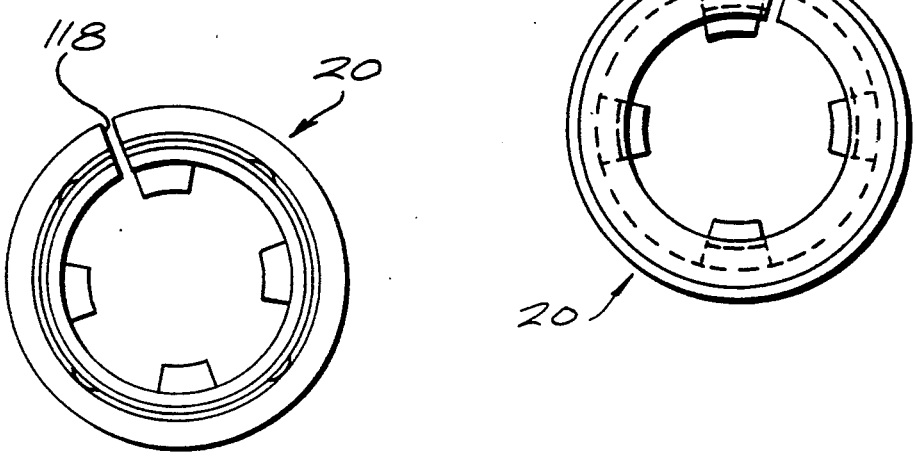
FIG. 6
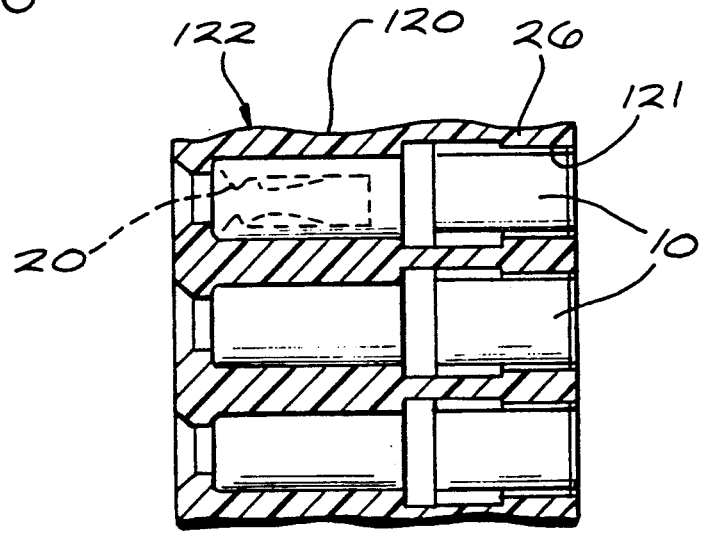
FIG. 7

FIG. 8
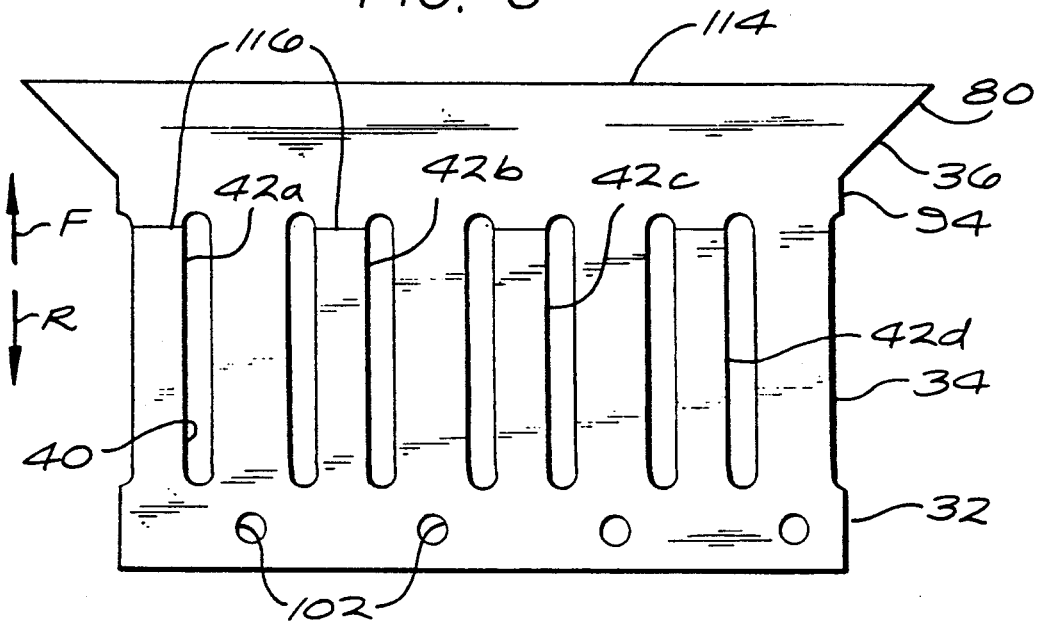
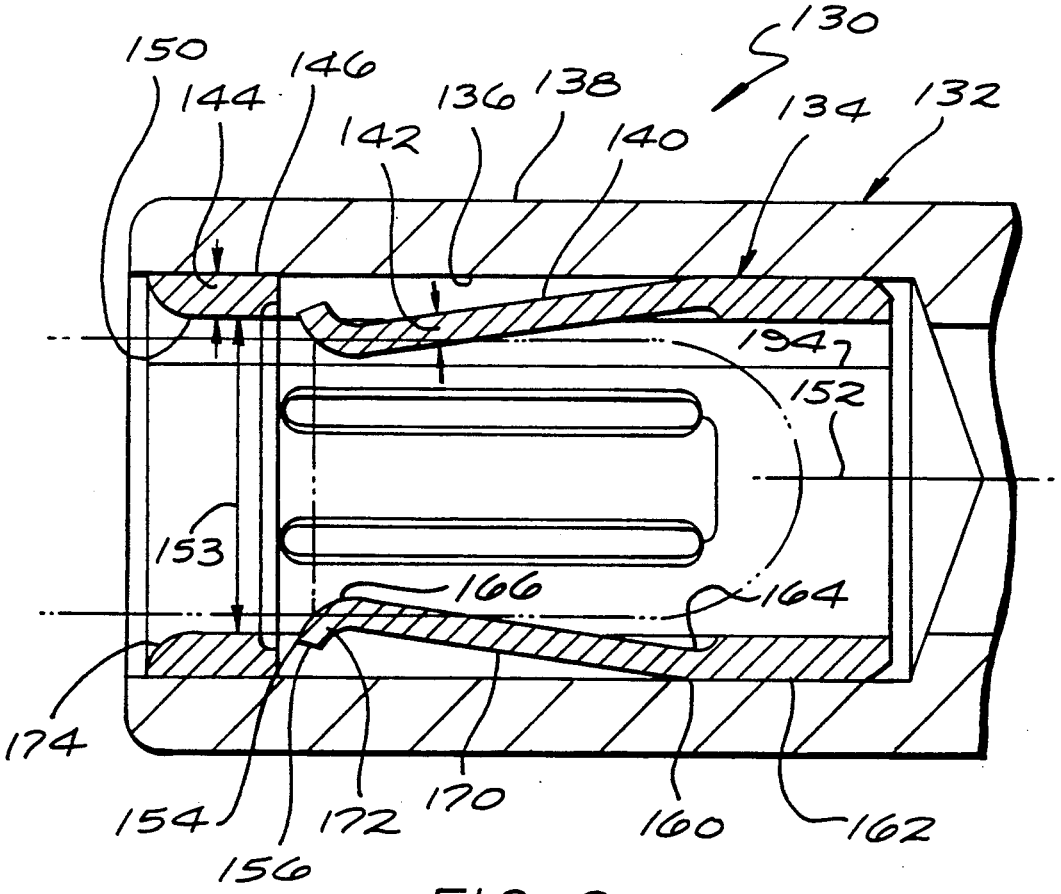
FIG. 9

CLOSED ENTRY SOCKET CONTACT ASSEMBLY

This is a continuation of application Ser. No. 578,981 filed Sept. 7, 1990, now abandoned.

BACKGROUND OF THE INVENTION

High reliability connectors such as those used in defense applications, generally use socket contact assemblies with seamless exteriors. A common type of socket assembly, such as shown in FIG. 1, includes a solid body with a cavity formed by machining or impact extrusion to form a solid body with a tubular front. Slots are machined in the tubular front to form forwardly extending tines which are crimped (permanently bent) so their front ends engage a pin contact entering the cavity. A hood is installed around the body to protect the tines and to form a closed entry region that limits the size of pin contacts that can enter between the tines. While such a socket assembly is reliable, it is expensive to manufacture.

Another type of seamless socket shown in FIG. 2, includes a solid body with a cylindrical cavity, and a clip formed of rolled sheet metal installed in the cavity. The clip has rearwardly extending tines, and the front of the clip forms a closed entry region. While this socket assembly can be manufactured at low cost, it has the disadvantage that there is a long distance (Y) between the initial and final points of contact of the tines with a pin contact. Connectors used in defense applications generally must have a short distance between the initial and final points of contact.

It should be noted that there are many types of very low cost socket contacts formed entirely of rolled or folded pieces of sheet metal without any seamless tube around them. However, such metal contacts are subject to damage during handling, between the time they are initially manufactured and the time they are shipped to a customer and installed by the customer in a connector housing. A socket contact assembly which had a seamless exterior, which had a protected spring clip therein with initial and final points of contact that were close together which had a closed entry region at the opening to the cavity, and which could be constructed at low cost, would be of considerable value.

SUMMARY OF THE INVENTION

In accordance with one embodiment of the present invention, a socket contact assembly suitable for high reliability applications is provided, which has a seamless exterior, closed entry region, and closely spaced initial and final points of contact, which can be constructed at low cost. The assembly includes a seamless barrel having a wire-terminating rear portion, and having a front portion with a largely cylindrical cavity open at the front end of the barrel. A clip that lies in the cavity, is formed of sheet metal rolled into a tubular shape and having an axis coincident with the axis of the cavity. The clip has a plurality of tines extending from a rearward clip portion in a forward direction but at a radially-inward incline, with the front parts of the tines having a reverse bend. The tips of the tines have radially inner edges lying on a first imaginary circle. The forward portion of the clip has a closed entry region having an inside diameter no greater than the diameter of the first imaginary circle containing the inside edges of the tine tips.

In one clip construction, the front portion of the clip has a flared forward part, with the flare extending to a smaller diameter than the rest of the clip. In another clip construction, a thick piece of sheet metal from which the clip is formed, has a reduced thickness at the tines, so the thick front portion of the clip can be substantially cylindrical and still have a small inside diameter forming a closed entry region.

The novel features of the invention are set forth with particularity in the appended claims. The invention will be best understood from the following description when read in conjunction with the accompanying drawings.

BRIEF DESCRIPTION OF THE DRAWINGS

FIG. 4 is a sectional side view of the clip of the socket contact assembly of FIG. 1.

FIG. 5 is a front elevation view taken on the line 5—5 of FIG. 4.

FIG. 6 is a rear elevation view taken on the line 6—6 of FIG. 4.

FIG. 7 is a partial sectional view of a connector which holds socket contact assemblies of the type shown in FIG. 3.

FIG. 8 is a plan view of a piece of sheet metal from which the clip of FIG. 4 is formed.

FIG. 9 is a partial sectional view of a socket contact assembly constructed in accordance with another embodiment of the invention.

DESCRIPTION OF THE PREFERRED EMBODIMENTS

Figure 1:
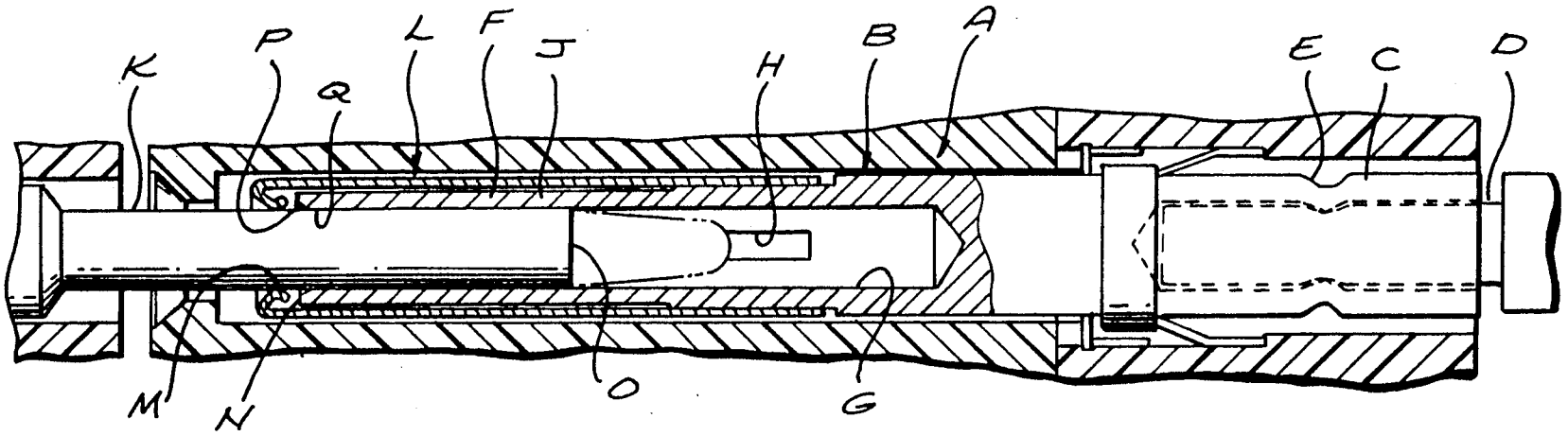
FIG. 1 PRIOR ART
FIG. 1 is a sectional side view of a socket contact assembly constructed in accordance with the prior art.

FIG. 1 illustrates a prior art high reliability socket contact assembly A which includes a socket body B having a rearward portion C with a hole that receives a conductor D of a wire and is crimped at E to hold the conductor in place. The front portion F of the body has a cylindrical cavity G and has slots H that divide the front portion into individual tines J. The tines are crimped or permanently bent, so their front ends are closer together than their rear ends, to firmly engage a pin contact K. A protective hood L press-fitted onto the front portion of the socket body, has a flare or chamfer M which forms a restricted entry region that prevents the entry of large diameter pin contacts that could press against the tips N of the tines and damage them. When a test pin contact with a square end indicated at 0 is inserted, it engages the tines at an initial point of contact P. Further insertion of the imaginary square-ended pin contact K results in outward deflection of the contacts and engagement of the pin at a point Q. The initial and final engagement points P, Q are closely spaced, which is highly desirable. The length of the pin contacts is preferably as short as possible to avoid damage to them. However, a considerable length is required because the depth of pin insertion varies with many factors such as how tight a coupling nut connecting the two connectors is turned. As a result, it is important that the points P, Q lie close together. While the socket assembly A is highly reliable, it is expensive to manufacture because of the cost of cutting the slots H, heat treating the front portion for springiness of the tines and annealing the rearward portion C to permit crimping to a wire, and forming the hood L with a seamless exterior. Both the hood and socket body B must be seamless to avoid damage to them during handling, between the time of manufacturer and the time when a customer installs the contact assembly in a connector housing.

Figure 2:
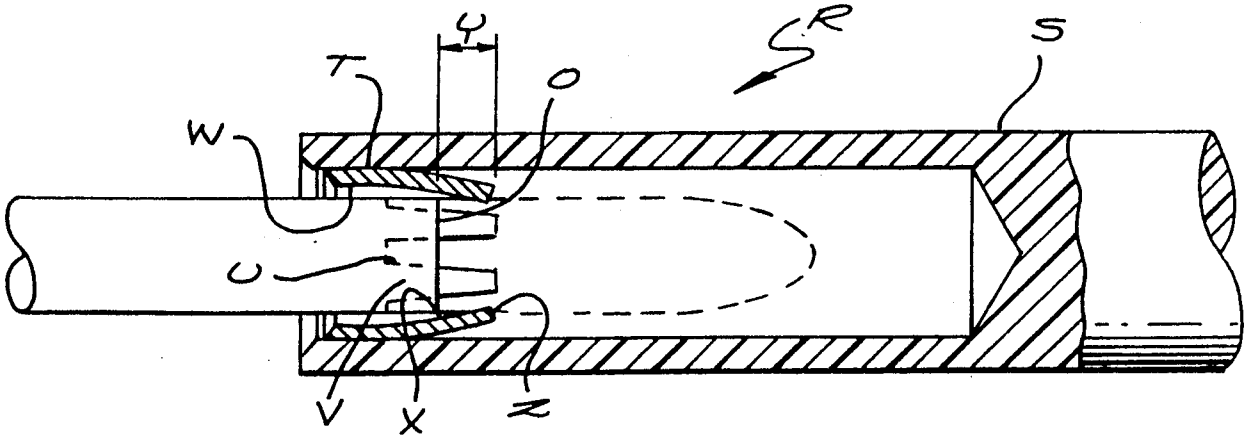
FIG. 2 PRIOR ART
FIG. 2 is a partial sectional view of another socket contact assembly constructed in accordance with the prior art.

FIG. 2 illustrates another prior art socket contact assembly R, which also includes a seamless socket body S that holds a spring clip T. The spring clip is formed of a rolled piece of sheet metal with slots U forming tines extending in a rearward direction. The forward end W of the clip serves as a closed entry region that limits the size of contact pins that can be inserted. An important disadvantage of this type of assembly is that the initial point of contact X with a square ended pin 0, is spaced a considerable distance Y from the final point of contact Z, which makes this assembly unacceptable in many applications. Otherwise, this assembly has many advantages, because the socket body with a simple cylindrical cavity can be constructed at low cost, and because the rolled sheet metal clip T can also be constructed and installed at low cost.

Figure 3:
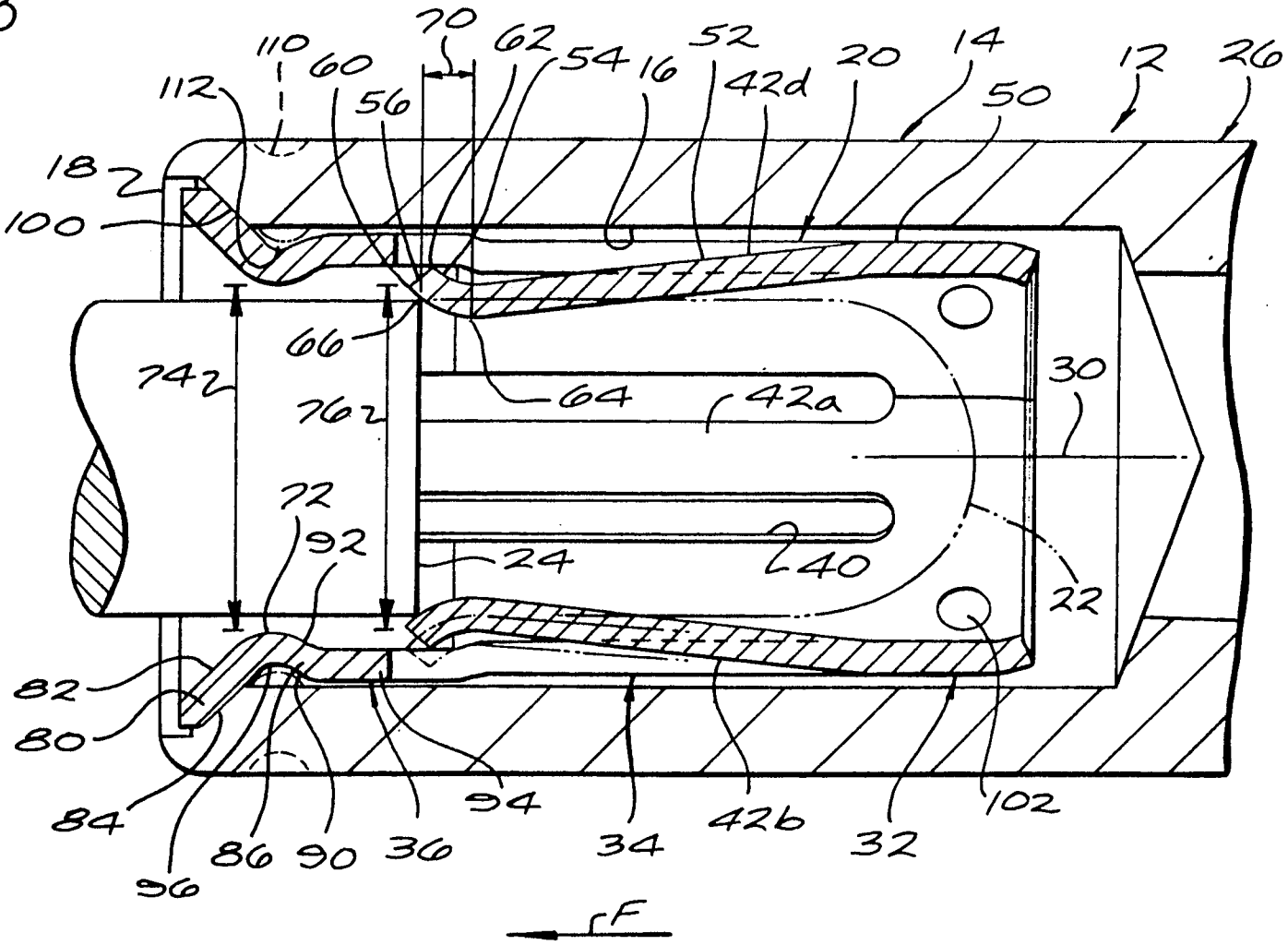
FIG. 3 is a partial sectional view of a contact assembly constructed in accordance with the present invention, and showing a square ended pin contact partially installed therein.

FIG. 3 illustrates a portion of a socket contact assembly 10 of the present invention, which includes a seamless body or barrel 12 having a forward portion 14 with a largely cylindrical cavity 16 open to the front end 18 of the barrel. The assembly also includes a spring clip 20 installed in the cavity of the barrel, and designed to make contact with a pin contact 22 of a typical type having a well rounded end, or even a test contact with a square end indicated at 24. The barrel 12 is similar to those of the prior art, in that it is formed of solid metal stock such as a metal rod, with the cavity 16 formed by machining or impact extrusion to form a sturdy seamless barrel that can be handled without damaging the spring clip. It is noted that the barrel has a wire terminating rear portion 26 similar to those of the prior art, such as shown at C in FIG. 1, for receiving and crimping around a wire conductor or which may be of another type.

The barrel 12 and spring clip 20 are coaxial at an axis 30. The clip has a rearward portion 32 which presses firmly against the walls of the barrel cavity 16 (at its dimples 102), a middle portion 34 that extends forwardly in the direction of arrow F from the rearward portion, and a forward portion 36 that also presses firmly against the inside of the cavity. The middle portion 34 of the clip has a plurality of slots 40 that divide it into four tines 42*a*–42*d*.

Each tine has a rear part 50 supported on the rearward portion 32 of the clip. Each tine also has a middle part 52 that has been bent or crimped to extend at a forward-inward incline, that is with a radially inward (toward axis 30)-forward directional component, so that progressively forward locations are progressively closer to the axis 30. Each tine also has a forward part 54 extending at a forward-outward incline, that is, with a radially outward-forward directional component, and ending in a tip 56. The tip 56 has radially inner and outer edges 60, 62.

The point 64 where the radially inner surface of the middle and forward parts 52, 54 meet, is the point where the tine engages the fully inserted pin contact 22. A point 66 along the forward part 54 of the tine, is the point where a square end 24 of a test contact will initially engage the tine. The distance 70 between the initial and final points of engagement, is relatively small, such as less than ¼th the diameter of and therefore meets the requirements for such distance as discussed above.

The forward portion 36 of the clip forms a closed entry region 72 that limits the size (diameter) of pin contact 22 that can be inserted into the socket assembly. The closed entry region lies on an imaginary circle of a diameter 74, which prevents the passage of pin contacts of a diameter greater than the diameter 74. If the small diameter closed entry region 74 were not provided, then a pin contact with a substantially square end and of a large diameter could be inserted into the assembly and engage the inner edges 60 of the tines. Then, instead of deflecting the tines outwardly, the pin contact would crumple the tines in a column-like collapse, and damage the contact assembly. The radially inner edges 60 of the tips 56 lie on an imaginary circle of a diameter 76. The diameter 74 of the closed entry region 72 should be as small as, and preferably smaller than the diameter 76 of a circle on which the tip inner edges lie, to protect the tines.

The forward portion 36 of the clip includes a flared front part 80 with radially inner and outer surfaces 82, 84 that are both tapered at a forward-outward incline (i.e. in a radially inward-rearward direction). Both inner and outer surfaces 82, 84 are tapered due to the fact that the clip is formed from sheet metal so its opposite faces are parallel. The rear end of the flared front part 80 forms the closed entry region 72. The clip forward portion also includes a middle part 86 extending rearwardly from the region 72 and tapered at a forward-inward incline (i.e. in a radially outward-rearward direction) at both its inner and outer surfaces 90, 92. The forward portion also includes a rear part 94 which is substantially cylindrical and which presses firmly against the inner walls of the barrel cavity 16.

The flared front part 80 provides a good guide surface for guiding a pin contact through the closed entry regions 72. The change in diameter along the flare is a plurality of times greater than the thickness of the sheet metal. The closed entry region 72 smoothly guides the contacts into the rest of the clip, because it has a smoothly rounded surface (with a radius of curvature greater than the thickness of the sheet metal) where the front and middle parts 80, 86 meet. It is noted that the outside surface of the clip at the point 96 directly outside the closed entry region 72, has a smaller diameter than most of the rest of the clip and of the walls of the cavity 16. The front of the barrel has a tapered surface 100 that matches the taper of the clip flared front part 80 to securely back it up.

The rearward portion 32 of the clip has four dimples 102 that project radially outwardly from surrounding areas of the rearward portion, and which press firmly against the walls of the cavity. The clip is held in place in the cavity at its rearward portion by the four dimples 102, and at its forward portion 36 by the rear part 94 thereof which presses firmly against the walls of the cavity. Additional holding power can be provided by radially inwardly deforming the barrel at the location 110, to form an inward projection 112 of the cavity walls. The projection 112 lies around the inwardly projecting bump or closed end region 72 of the clip where the outer surface 96 has a smaller diameter than that of the walls of the cavity without the projection 112. The projection 112 can be in the form of a plurality of depressions, or alternately can be in the form of a continual ring-shaped depression around the circumference of the barrel.

FIG. 8 illustrates a piece of sheet metal 114 which lies flat, and which can be rolled up to form the clip 20 of FIGS. 3 and 4. The flat piece of sheet metal has a largely constant width along the rearward and middle portions 32, 34, but the forward portion 36 has a greater width, at least along the flared front part 80 where the sheet has a progressively greater width at progressively more forward locations in the direction F. The sheet metal is initially cut from a larger sheet. The slots 40 are cut in the sheet metal to extend in forward and rearward directions F and R, and lancing cuts 116 are formed at the forward end of locations between adjacent pairs of slots, to form the tines 42*a*–42*d*. Also, depressions are formed to leave the dimples 102. Then the piece of sheet metal is rolled to form a clip. As shown in FIG. 6, before the clip is installed, there is a gap 118 at the opposite sides of the rolled sheet metal. However, the width of the sheet metal is closely controlled with respect to the diameter of the barrel cavity, so as the clip is inserted into the cavity, the gap 116 is closed at least at the rear part 94 of the front portion. As a result, the rear part 94 presses firmly against the walls of the cavity to hold the clip in place (in addition to the pressure of the dimples against the cavity walls).

After the clips are installed in the barrels, the resulting socket contact assemblies are placed in a container and shipped to a customer. The customer then loads the contact assemblies into an insulative housing such as shown at 120 in FIG. 7. Where the wire termination rearward portions 26 of the barrels are to be crimped to conductors as in FIG. 1, the conductors will be first inserted and crimped in place before the contact assemblies are inserted into holes 121 of the housing 120 of a connector 122. The contact assemblies can encounter considerable handling when they are removed from a shipping container, loaded in apparatus for terminating their rearward portions, and inserted into the connector housing. The fact that the barrel is seamless and has thick walls, and completely surrounds the clip 20, results in high reliability that the installed contact assembly will function well if it has been initially manufactured without defects.

In one contact assembly of the type illustrated in FIG. that applicants have designed, the barrel has an outer diameter of 0.076 inch, the clip is designed to accept pin contacts of a diameter of 0.040 inch, and the distance 70 between the initial and final points of contact is 0.006 inch. The clip is heavily gold plated, while the barrel is only thinly gold plated. The gold plating of the barrel makes it difficult to inwardly deform the front end of the barrel to use that as a closed entry region, as such deformation of a small diameter barrel could crack the plating.

Figure 10:
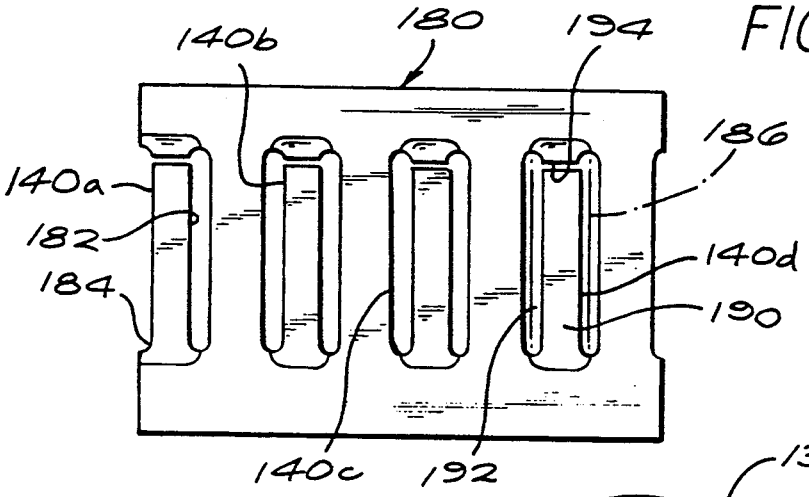
FIG. 10 is a plan view of a piece of sheet metal from which the clip of the socket contact assembly of FIG. 9 is formed.
Figure 11:
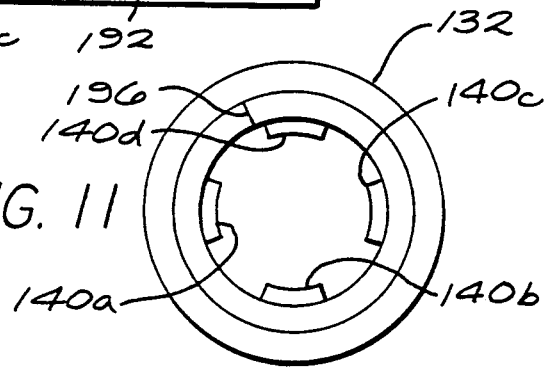
FIG. 11 is a front elevation view of the socket contact assembly of FIG. 9.

While the contact assembly of FIG. 3 is of relatively simple design, and can be manufactured at low cost once tooling is made, it requires relatively costly tooling to roll the piece of sheet metal 114 because of the fact that its front part is of tapered width. FIGS. 9–11 illustrate another socket contact assembly 130 which can be constructed with lower cost tooling.

The contact assembly 130 of FIG. 9 has a seamless barrel 132 formed by machining or impact extrusion of solid metal stock, and has a clip 134 lying in a cavity 136 formed in the forward portion 138 of the barrel. The clip is formed of a piece of sheet metal, but the tines 140 are of a smaller thickness 142 than the rest of the sheet metal and specifically are less than the thickness 144 of a forward portion 146 of the clip. The greater thickness 144 of the forward portion, results in the radially inner surface 150 (radially means with respect to the axis 152 of the barrel and clip) having a diameter 153 equal to or (preferably) smaller than an imaginary circle on which lie the radially inner edges 154 of the tine tips 156. The rearward parts 160 of the tines have the same radially outer diameter as the adjacent rearward portion 162 and of the forward portion 146. However, the tine rearward parts 160 have inner surfaces 164 of greater diameter than the clip rearward portion 162 This results in the tines extending at a greater angle or incline from the axis 152 for a contact point 166 of given initial inside diameter (before a pin is inserted). The middle and forward parts 170, 172 of the tines are similar to those of the clip of FIG. 3. The extreme front end of the clip at 174 is preferably bevelled. Although the bevelled portion 174 is not bevelled over as great a difference in diameter as the clip of FIG. 3, the clip 134 of FIG. 9 can be constructed with simpler tooling.

FIG. 10 illustrates a piece of flat sheet material 180 from which the clip of FIG. 9 can be constructed. The piece of sheet metal can be cut as a rectangle from a larger sheet. Then slots 182 are formed in the sheet, with slot-like indentations 184 at the opposite sides of the sheet. A next step is to apply a punch having the shape indicated at 186, to areas that include the tines 140*a*–140*d*. The punch is pressed with sufficient force to reduce the thickness of a corresponding area 190 of the sheet, with most of the area to form a tine. An initially thick sheet such as of 0.006 inch may be used, with the punch decreasing the thickness to perhaps 0.004 inch. After the punch has been applied, areas such as 192 on either side of the tine, which have been extended by the punching operation, are trimmed away. The next step is to lance cut the sheet at the locations 194 to form the tine ends. The next step is to bend or crimp the tines such as 140*a* to the configurations shown in FIG. 9. Then, the piece of sheet metal 180 is rolled into a tubular shape.

The rolling of the piece of sheet metal 180 (i.e. bending substantially all portions about an axis, as opposed to making a few sharp 90 bends into a square cross-section) can be relatively easily accomplished because its forward and rearward ends are of substantially the same width. After rolling, the clip is installed in the cavity of the barrel 132. The width of the piece of sheet metal is closely controlled so when rolled and inserted, the rearward portion 162 and forward portion 146 of the clip press firmly against the walls of the barrel cavity to hold the clip in place. As shown in FIG. 11, the opposite sides of the sheet metal abut one another at the location 196.

Figure 12:
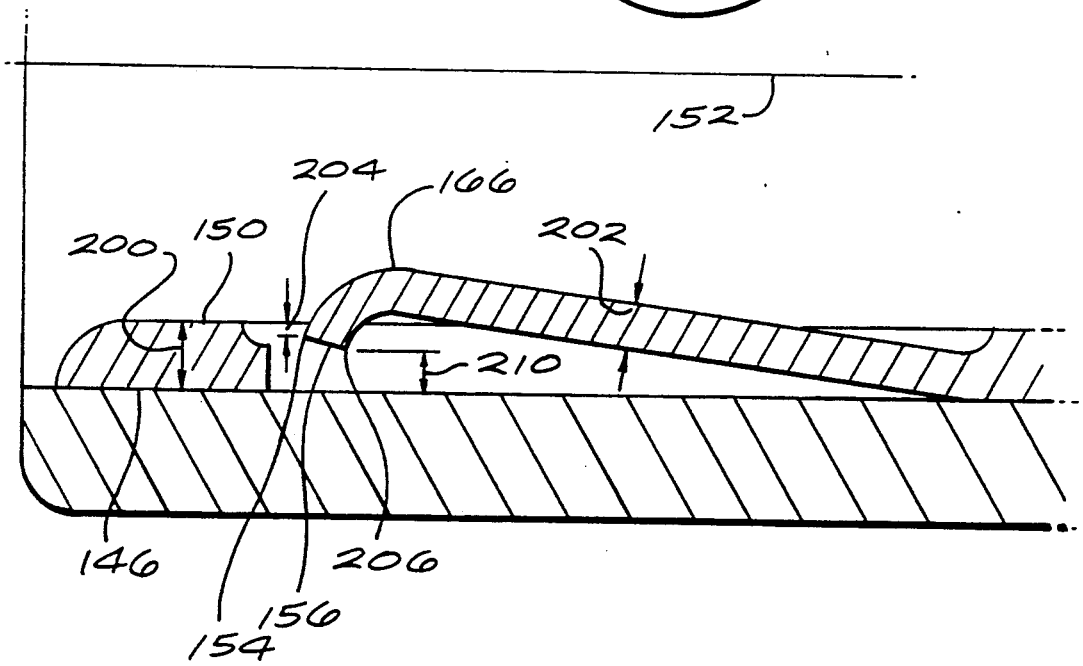
FIG. 12 is an enlarged sectional view of a portion of the socket contact assembly of FIG. 9.

FIG. 12 illustrates a portion of the spring clip of FIG. 9 that applicants have designed. The clip is formed of sheet metal and most of the sheet metal has a thickness 200 of 0.006 inch, and with tines 140 of a thickness 202 of 0.004 inch. The radially inner edge 154 of the tine tip lies radially outward of the inner face 150 of the thick forward clip portion 146, by a distance 204 which is a minimum of 0.001 inch (at least 2% of the inside diameter 153 of the closed entry region). The outer edge 206 of the tine tip can deflect outwardly by a distance 210 of 0.004 inch. The contact point 166 can be deflected outwardly by up to 0.005 inch (0.001 more than distance 210) before the tine is permanently set. The clip is designed to receive pin contacts of a nominal diameter of 0.040 inch, and a maximum diameter of 0.041 inch. The closed entry region (150 in FIG. 9) has a diameter 152 of 0.044 inch with a tolerance of 0.001 inch.

Thus, the invention provides a socket contact assembly of a high reliability type that has a seamless exterior, that has a closed entry region at the front which limits the size of pins that can be inserted, and that has only a small distance between the initial and final points of engagement of the tines with an inserted pin contact. The assembly includes a seamless barrel whose front portion has walls forming a substantially cylindrical cavity, and a spring clip formed of a sheet of metal rolled into a tubular shape. The clip has a rearward portion that presses firmly against the cavity walls, a middle portion forming a plurality of forwardly-extending tines, and a forward portion which also presses firmly against the cavity walls. Each tine has a middle part inclined in a forward-inward direction and a forward part inclined in a forward-outward direction, and ending in a tip. The radially inner edges of the tine tips lie on an imaginary circle of a first diameter, while the forward portion of the clip forms a closed entry region having an inside diameter no greater than the diameter of the first circle. In one construction, the forward portion of the sheet metal clip has a flared front part that is tapered in a forward-outward direction and has a middle part tapered in a rearward-outward direction; the intersection of the two being the clip location of minimum diameter and forming the closed entry region. In another construction, the piece of sheet metal forming the clip has a reduced thickness at the tines, so that the thicker portion of the sheet metal at the forward clip portion has a smaller inside diameter and can serve as a closed entry region to protect the tips of the tines.

Although particular embodiments of the invention have been described and illustrated herein, it is recognized that modifications and variations may readily occur to those skilled in the art, and consequently, it is intended that the claims interpreted to cover such modifications and equivalents.

What is claimed is:

1. A socket contact assembly comprising:

an electrically conductive seamless barrel having a wire-terminating rear portion and having a front portion with a front end, said front portion having walls forming a cylindrical cavity that is open at said front end;

a clip formed of a sheet of metal rolled into a cylindrical shape about an axis and lying in said cavity, said clip having a rearward portion, a plurality of tines extending forwardly from said rearward portion with said tines having free forward tips, and a forward portion lying forward of said tine tips;

each tine having a middle part extending primarily forward but with a radially inward-forward directional component, and each tine having a forward part extending with a radially outward-forward directional component and ending in one of said tips, said tips having radially inner and outer edges, and said tip inner edges lie on a first imaginary circle centered on said axis;

said barrel cavity walls being seamless and lying closely around said clip forward portion to prevent its expansion and to protect said clip during handling of said contact assembly, and said clip forward portion presses against said cavity walls to securely hold said clip in said cavity;

said clip forward portion forming a closed entry region that has an inside diameter at least as small as said first imaginary circle on which said tip inner edges lie as said clip forward portion presses against said barrel cavity walls;

said sheet metal clip forward portion includes a flared front part with radially inner and outer surfaces that are both tapered in a radially inward-rearward direction, and said flared front part has a rear end with a smaller inside diameter than the diameter of said first imaginary circle which lies on said tip inner edges;

said clip forward portion also including a middle part extending rearwardly from said rear end of said flared front part with said middle part having radially inner and outer surfaces that are both tapered in a radially inward-rearward direction, the inner surface of said forward portion forming said closed entry region at an intersection between said flared front part and said tapered middle part.

2. The contact assembly described in claim 1 wherein:

said flared front part of said clip has a front end of greater diameter than any other part of said clip, and said barrel front portion has a tapered front part that matches and abuts the radially outer surface of said clip flared front part.

3. The contact assembly described in claim 1 wherein:

said clip forward portion includes a cylindrical part extending rearward of said middle part and forward of said tine forward parts and pressing firmly against said cavity walls.

4. The contact assembly described in claim 1 wherein:

said sheet of metal has a smaller thickness at said tines than at said forward portion, and most of said radially inner surface of said forward portion lies on an imaginary cylinder and forms said closed entry region.

5. A socket contact assembly comprising:

an elongated seamless metal barrel having an axis, a rear end termination portion, and a front portion having walls forming a substantially cylindrical cavity centered on said axis, said cavity having a front end which is tapered in a radially outwardly-forward direction;

a clip formed of a piece of sheet metal rolled into a tube and having forward, rearward, and middle portions, said clip lying in said barrel cavity and having an axis coaxial with said barrel axis;

said clip middle portion having a plurality of tines, said clip middle portion having a plurality of slots extending primarily parallel to said axis with at least one of said tines formed between a pair of said slots, and with each tine having a free forward end ending in a free tip;

each of said tines has a middle part extending in a radially inward-forward direction and has a forward part extending in a radially outward-forward direction;

said tips of said tines have radially inner edges, and an imaginary circle of a first diameter passes through the inner edges of said tine tips;

said clip forward portion pressing radially outwardly against said barrel, and said clip forward portion having a front part flared in a radially outward-forward direction and abutting said barrel tapered front end, a middle part extending from the rear end of said flared front part in a radially outward-rearward direction, and a close entry region at the intersection of said front and middle parts, said closed entry region having an inside diameter that is less than said first diameter.

6. The contact assembly described in claim 5 wherein:

said clip forward portion has a substantially cylindrical rear part extending forward of said tines and pressing firmly against the walls of said cavity.

7. A socket contact assembly comprising:

an elongated seamless metal barrel having an axis, a rear end termination portion, and a front portion having walls forming a substantially cylindrical cavity centered on said axis;

a clip formed of a piece of sheet metal rolled into a tube and having forward, rearward, and middle portions, said clip lying in said barrel cavity and having an axis coaxial with said barrel axis;

said clip middle portion having a plurality of tines, said clip middle portion having a plurality of slots extending primarily parallel to said axis with at least one of said tines formed between a pair of said slots, and with each tine having a free forward end ending in a free tip;

each of said tines has a middle part extending in a radially inward-forward direction and has a forward part extending in a radially outward-forward direction;

said tine tips have radially inner and outer edges, with said tip inner edges lying on an imaginary circle of a first diameter;

said piece of sheet metal has a reduced thickness at said tines, with most said clip forward portion having a greater thickness than said tines, and with said forward portion having a radially inner diameter that is smaller than said first diameter.

8. The contact assembly described in claim 7 wherein:

said piece of sheet metal has outer and inner faces which respectively form the radially outer and inner surfaces of said clip;

said tines have rear ends with outer surfaces that are flush with the outer surface of said rearward clip portion, and with inner surfaces that are recessed from the inner surface of said rearward clip portion.

9. A socket contact assembly comprising:

an electrically conductive seamless barrel having a wire-terminating rear portion and having a front portion with a front end, said front portion having walls forming a cavity that is open at said front end;

a clip formed of a sheet metal rolled into a tubular shape about an axis and lying in said cavity, said clip having a rearward portion, a plurality of tines extending forwardly from said rearward portion with said tines having free forward tips, and a forward portion lying forward of said tine tips;

each tine having a middle part extending primarily forward but with a radially inward-forward directional component, and each tine having a forward part extending with a radially outward-forward directional component and ending in said tip, said tip having radially inner and outer edges, and said tip inner edges lie on a first imaginary circle centered on said axis;

said clip forward portion forming a closed entry region that has an inside diameter no greater than said first imaginary circle;

said barrel cavity walls being seamless and lying around said clip forward portion to prevent expansion of said closed entry region and to protect said clip during handling of said contact assembly, and said clip presses against said cavity walls to securely hold said clip in said cavity;

said sheet of metal has a smaller thickness at said tines than at said forward portion, and said forward portion has a radially inner surface with most of said radially inner surface lying on an imaginary cylinder and forming said closed entry region.

10. A socket contact assembly comprising:

an electrically conductive seamless barrel having a wire-terminating rear portion and having a front portion with a front end, said front portion having walls forming a cylindrical cavity that is open at said front end;

a clip formed of a sheet of metal rolled into a cylindrical shape about an axis and lying in said cavity, said clip having a rearward portion, a plurality of tines extending forwardly from said rearward portion with said tines having free forward tips, and a forward portion lying forward of said tine tips;

each tine having a middle part extending primarily forward but with a radially inward-forward directional component, each tine having a forward part extending with a radially outward-forward directional component and ending in one of said tips, said tips having radially inner and outer edges, and said tip inner edges lie on a first imaginary circle centered on said axis;

said clip forward portion forming a closed entry region that has an inside diameter at least as small as said first imaginary circle on which said tip inner edges lie;

said barrel cavity walls being seamless and lying closely around said clip forward portion to prevent expansion of said closed entry region and to protect said clip during handling of said contact assembly, and said clip presses against said cavity walls to securely hold said clip in said cavity;

said sheet metal clip forward portion includes a flared front part with radially inner and outer surfaces that are both tapered in a radially inward-rearward direction, and said flared front part has a rear end with a smaller inside diameter than the diameter of said first imaginary circle which lies on said tip inner edges;

said clip forward portion also including a middle part extending rearwardly from said rear end of said flared front part with said middle part having radially inner and outer surfaces that are both tapered in a radially inward-rearward direction, the inner surface of said forward portion forming said closed entry region at an intersection between said flared front part and said tapered middle part, said rolled sheet of metal which forms said clip, when lying flat before it is rolled, has a largely constant width except at said front part of said front portion where said sheet has a progressively greater width at progressively more forward locations.

11. A socket contact assembly comprising:

an elongated seamless metal barrel having an axis, a rear end termination portion, and a front portion having walls forming a substantially cylindrical cavity centered on said axis, said cavity having a front end which is tapered in a radially outwardly-forward direction;

a clip formed of a piece of sheet metal rolled into a tube and having forward, rearward, and middle portions, said clip lying in said barrel cavity and having an axis coaxial with said barrel axis;

said clip middle portion having a plurality of tines, said clip middle portion having a plurality of slots extending primarily parallel to said axis with at least one of said tines formed between a pair of said slots, and with each tine having a free forward end ending in a free tip;

each of said tines has a middle part extending in a radially inward-forward direction and has a forward part extending in a radially outward-forward direction;

said tips of said tines have radially inner edges, and an imaginary circle of a first diameter passes through the inner edges of said tine tips;

said clip forward portion having a front part flared in a radially outward-forward direction and abutting said barrel tapered front end, a middle part extending from the rear end of said flared front part in a radially outward-rearward direction, and a close entry region at the intersection of said front and middle parts, said closed entry region having an inside diameter that is less than said first diameter;

said piece of sheet metal, in a flat unrolled configuration, is formed with said front part tapered in width to have a progressively greater width at progressively more forward locations therealong.

* * * * *